US009368296B2

(12) United States Patent
Holland et al.

(10) Patent No.: US 9,368,296 B2
(45) Date of Patent: Jun. 14, 2016

(54) FUSIBLE SWITCH ASSEMBLIES, AND LOAD BASE ASSEMBLIES, LINE BASE ASSEMBLIES, LINE BUS CONNECTOR ASSEMBLIES, FUSE CLIP ASSEMBLIES, FUSE CLIP AND LUG ASSEMBLIES, AND OPERATIONAL METHODS THEREOF

(71) Applicant: Siemens Industry, Inc., Alpharetta, GA (US)

(72) Inventors: Michael J. Holland, Hilliard, OH (US); Thomas Jameson, Bellefontaine, OH (US)

(73) Assignee: SIEMENS INDUSTRY, INC., Alpharetta, GA (US)

( * ) Notice: Subject to any disclaimer, the term of this patent is extended or adjusted under 35 U.S.C. 154(b) by 105 days.

(21) Appl. No.: 14/484,543

(22) Filed: Sep. 12, 2014

(65) Prior Publication Data

US 2016/0079687 A1 Mar. 17, 2016

(51) Int. Cl.

| | |
|---|---|
| ***H01H 9/02*** | (2006.01) |
| ***H01H 9/00*** | (2006.01) |
| ***H01H 85/00*** | (2006.01) |
| ***H01R 13/15*** | (2006.01) |
| *H01R 4/36* | (2006.01) |

(52) U.S. Cl.

CPC ..... *H01H 9/00* (2013.01); *H01H 85/00* (2013.01); *H01R 13/15* (2013.01); *H01R 4/36* (2013.01)

(58) Field of Classification Search

CPC ..... H01H 1/42; H01F 21/12; H01R 4/36
See application file for complete search history.

(56) References Cited

U.S. PATENT DOCUMENTS

| | | | | | |
|---|---|---|---|---|---|
| 2,942,228 | A * | 6/1960 | Swick | H01H 1/42 | 257/693 |
| 3,114,024 | A * | 12/1963 | Tillson | H01H 1/60 | 200/280 |
| 4,050,045 | A | 9/1977 | Lafreniere | | |
| 4,395,606 | A * | 7/1983 | Zaffrann | H01H 9/345 | 200/293 |
| 4,500,162 | A * | 2/1985 | Keglewitsch | H01R 13/113 | 439/830 |
| 5,118,314 | A | 6/1992 | Oakley | | |
| 5,990,439 | A * | 11/1999 | Pever | H01H 33/022 | 218/155 |
| 6,313,416 | B1 * | 11/2001 | Abroy | H01H 1/42 | 200/15 |
| 7,503,800 | B2 * | 3/2009 | Siglock | H01R 4/36 | 439/517 |
| 7,601,030 | B2 * | 10/2009 | Patel | H01F 21/12 | 439/620.3 |
| 8,651,894 | B1 | 2/2014 | Zhang | | |
| 8,702,455 | B1 | 4/2014 | Shoemaker | | |

OTHER PUBLICATIONS

Power Product Safety & Disconnect Switches. Siemens Canada Limited Power Product Catalogue. Jan. 25, 2013. (54 pages).
Siemens: Type VBII Visible Blade Disconnect Switches: Product Guide. www.usa.siemens.com/switches (12 Pages).

* cited by examiner

*Primary Examiner* — Xuong Chung Trans

(57) ABSTRACT

A fusible switch assembly including a line base assembly and load base assembly is disclosed. Line base assembly includes a low-profile fuse clip assembly and line bus connector assembly with single-piece connector body and sliding nuts. Load base assembly includes a fuse clip and lug assembly having a lug body including a multiple lugs and a fuse clip at least partially formed by the lug body. Line base assemblies, load base assemblies, fuse clip assemblies, line bus connector assemblies, fuse clip and lug assemblies, and methods of operating line base assemblies are provided, as are other aspects.

24 Claims, 12 Drawing Sheets

FUSIBLE SWITCH ASSEMBLIES, AND LOAD BASE ASSEMBLIES, LINE BASE ASSEMBLIES, LINE BUS CONNECTOR ASSEMBLIES, FUSE CLIP ASSEMBLIES, FUSE CLIP AND LUG ASSEMBLIES, AND OPERATIONAL METHODS THEREOF

FIELD

The invention relates generally to fusible switch assemblies, and line and load base assemblies and subcomponents thereof.

BACKGROUND

Conventional fusible switch assemblies include a line base assembly and load base assembly included within an enclosure, such as a metal switch box. Prior art fusible switch assemblies include load base assemblies including lugs adapted to allow connection to load conductor wires and clips adapted to allow connection of one or more fuses. Multi-pole, such as 3-pole, fusible switches having three fuses are commonplace.

The line base assembly of the fusible switch includes a rotor assembly having multiple blades adapted to electrically couple to stationary contacts when a rotation mechanism rotates the rotor assembly. The line base assembly also includes clips adapted to couple to a line-side end of the fuses, and a line bus connector assembly including lugs adapted to couple to line conductor wires.

However, such fusible switch assemblies, although adequate for their intended purposes, tend to be long, thus requiring relatively large enclosures, and may include high material costs. Furthermore, such switches may include multiple components. Thus, the fusible switches may tend to be costly to manufacture, because of their size and number of components.

Therefore, a need exists to reduce the size and complexity of such fusible switch assemblies.

SUMMARY

According to a first aspect, a load base assembly is provided. The load base assembly includes a load base; and one or more fuse clip and lug assembly coupled to the load base, the fuse clip and lug assembly including: a lug body including a first lug configured to receive a first electrical wire, and a second lug configured to receive a second electrical wire, first and second slide features formed in the lug body, first and second sliding nuts configured to be received in the slide first and second slide features, and a fuse clip at least partially formed by the lug body between the first lug and the second lug.

According to another aspect, a line base assembly is provided. The line base assembly includes a line base; a line bus connector assembly coupled to the line base, the line bus connector assembly including: a single-piece connector body including a first body portion and a second body portion extending from the first body portion and being thinner than first body portion, first and second line lugs formed in the first body portion, and first and second slide features formed in the single-piece connector body, first and second sliding nuts configured to be received in the first and second slide features, and stationary contacts coupled to the second body portion; and a fuse clip assembly configured to receive a fuse, the fuse clip assembly including: a clip body including a front side, a back side, and an underside, wherein the clip body is a single piece, a fuse clip formed in the clip body having a first clip side extending from the front side to the back side and a moveable clip side, and stationary contacts attached to, and extending downward from, the underside of the clip body, and wherein the stationary contacts are positioned within a projected footprint of the clip body.

According to another aspect, a line bus connector assembly is provided. The line bus connector assembly includes a single-piece connector body including a first body portion and a second body portion extending from the first body portion and being thinner than first body portion, first and second line lugs formed in the first portion, and first and second slide features formed in the single-piece connector body, first and second sliding nuts configured to be received in the first and second slide features, and stationary contacts coupled to the second body portion.

According to another aspect, a fuse clip assembly is provided. The fuse clip assembly includes a clip body including a front side, a back side, and an underside, wherein the clip body is a single piece, a fuse clip formed in the clip body having a first clip side extending from the front side to the back side and a moveable clip side, and stationary contacts attached to, and extending downward from, the underside of the clip body, and wherein the stationary contacts are positioned within a projected footprint of the clip body.

According to another aspect, a fusible switch assembly is provided. The fusible switch assembly includes a load base assembly including a load base; and one or more fuse clip and lug assembly coupled to the load base, the fuse clip and lug assembly including: a lug body including a first lug configured to receive a first electrical wire, and a second lug configured to receive a second electrical wire, first and second load slide features formed in the lug body, first and second load sliding nuts configured to be received in each of the first and second load slide features, and a fuse clip at least partially formed by the lug body between the first lug and the second lug; and a line base assembly including: a line base, a line bus connector assembly coupled to the line base, the line bus connector assembly including: a single-piece connector body including a first body portion and a second body portion extending from the first body portion and being thinner than first body portion, first and second line lugs formed in the first portion, and first and second line slide features formed in the single-piece connector body, first and second line sliding nuts configured to be received in the first and second line slide features, and line-side stationary contacts coupled to the second body portion; and a fuse clip assembly configured to receive a fuse, the fuse clip assembly including a clip body including a front side, a back side, and an underside, wherein the clip body is a single piece, a fuse clip formed in the clip body having a first clip side extending from the front side to the back side and a moveable clip side, and load-side stationary contacts attached to, and extending downward from, the underside of the clip body, and wherein the stationary contacts are positioned within a projected footprint of the clip body.

According to another aspect, a fuse clip and lug assembly is provided. The fuse clip and lug assembly includes a lug body including a first lug configured to receive a first electrical wire, and a second lug configured to receive a second electrical wire, first and second slide features formed in the lug body, first and second sliding nuts configured to be received in the slide first and second slide features, and a fuse clip at least partially formed by the lug body between the first lug and the second lug.

According to another aspect, a fuse clip assembly is provided. The fuse clip assembly includes a body, a fuse clip at least partially formed by the body, the fuse clip including a first clip side and a moveable clip side and at least one slot formed therein, the moveable clip side including a spring member, and a fuse rejection element including a crossbar that registers in the slot formed in the fuse clip.

According to another aspect, a method of operating a line base assembly is provided. The method includes providing a line base assembly including a line bus connector assembly and a fuse clip assembly, the line bus connector assembly including a single-piece connector body having a first body portion and a second body portion, and line-side stationary contacts coupled to the second body portion, the fuse clip assembly including a clip body, a fuse clip formed in the clip body having a first clip side extending from a front side to a back side and a moveable clip side, and load-side stationary contacts attached to, and extending downward from, the underside of the clip body, and wherein the load-side stationary contacts are positioned within a projected footprint of the clip body, providing a rotor assembly including first blades and second blades, and rotating the rotor assembly to engage the first blades with the line-side stationary contacts and the second blades with the load-side stationary contacts underneath the projected footprint of the clip body.

Still other aspects, features, and advantages may be readily apparent from the following description wherein a number of example embodiments are described and illustrated, including the best mode contemplated for carrying out the invention. The invention may be capable of other embodiments, and its several details may be modified, all without departing from the scope of the invention. Accordingly, the drawings and descriptions are to be regarded as illustrative in nature, and not as restrictive. The drawings are not necessarily drawn to scale. The invention covers all modifications, equivalents, and alternatives falling within the scope of the invention.

DESCRIPTION

Figure 1:
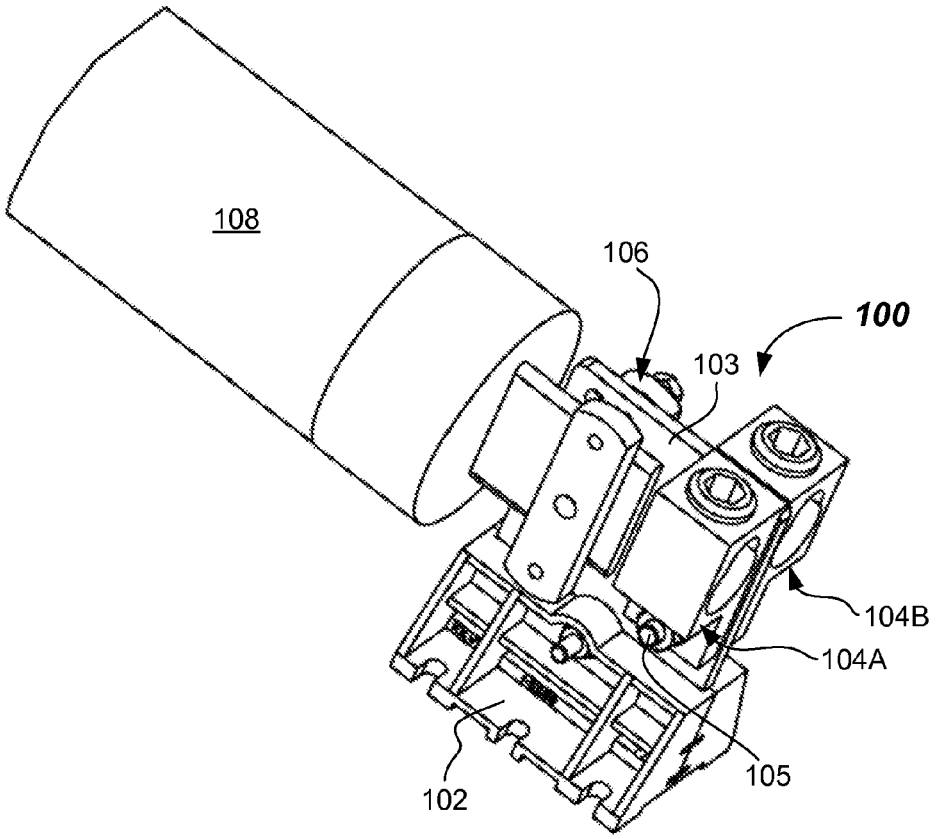
FIG. 1 Prior Art
FIG. 1 illustrates a perspective view of a load base assembly of a fusible disconnect switch according to the prior art.

FIG. 1 illustrates a perspective view of an embodiment of a load base assembly 100 according to the prior art. Load base assembly 100 includes a load base 102, a conductive stab 103, a first lug assembly 104A attached to a first side of the conductive stab 103, and a second lug assembly 1048 attached to a second side of the conductive stab 103, such as by fastener 105. The fuse 108 (only a portion shown) may be coupled to the load base assembly 100 by a coupler 106 that bolts the tang of the fuse 108 to the conductive stab 103. When more than one pole is included in a fusible switch assembly, multiple ones of the depicted load base assembly 100 are used and mounted to a switch box in a side-by-side arrangement. However, this structure, although entirely functional, includes many pieces and securing the fuse 108 may be labor intensive.

Reference will now be made in detail to the example embodiments of this disclosure, which are illustrated in the accompanying drawings. Wherever possible, the same reference numbers will be used throughout the drawings to refer to the same or like parts.

The aforementioned problem of excessive size and complexity is overcome by embodiments of the invention. In particular, fusible switch assemblies including line base assemblies and load base assemblies are described herein. Subassemblies and components thereof such as fuse clip assemblies, fuse clip and lug and assemblies, and line bus connector assemblies described herein aid in the provision of a compact construction resulting in substantially shorter component length, and fewer components.

Embodiments of fusible switch assemblies, line base assemblies, load base assemblies and components thereof will be explained in greater detail below with reference to FIGS. 2-10 herein.

Load Base Assembly

Figure 2:
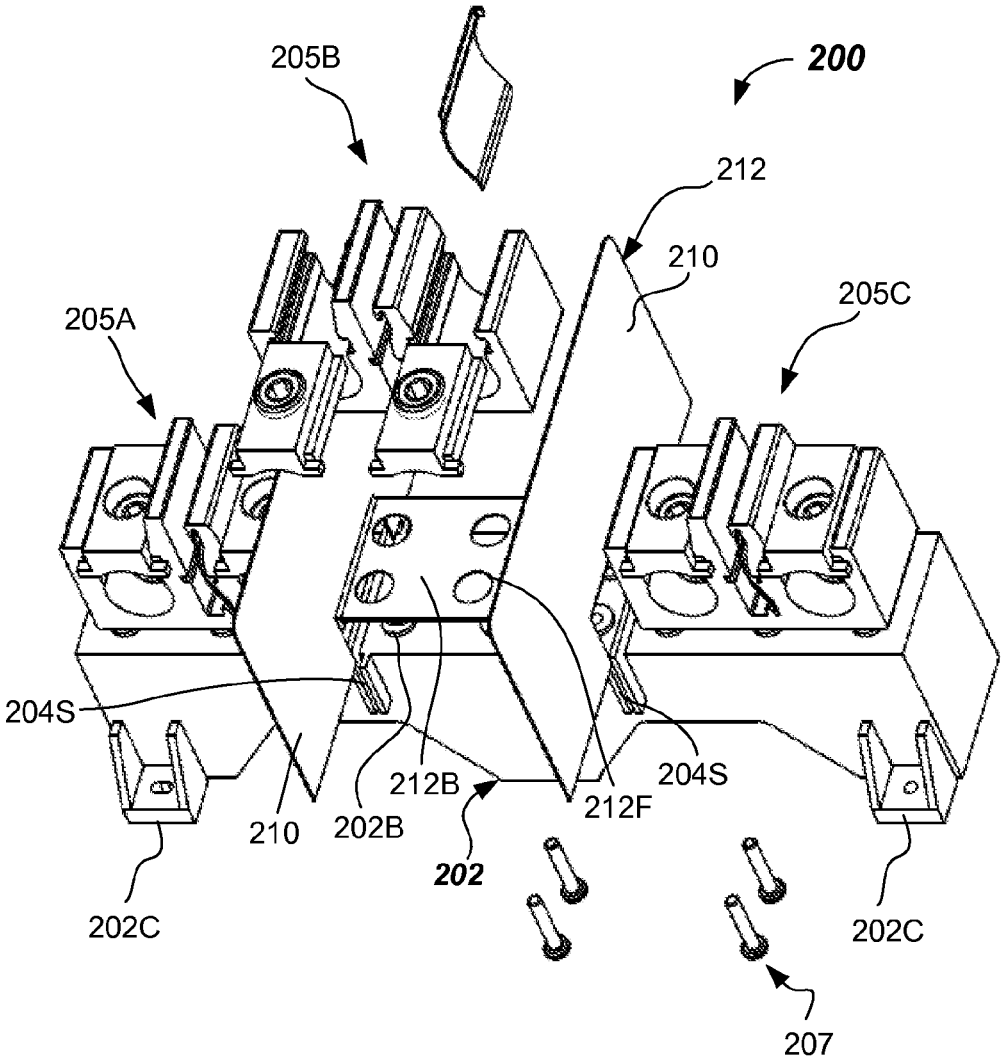
FIG. 2 illustrates a partially-exploded perspective view of a load base assembly according to embodiments.
Figure 9:
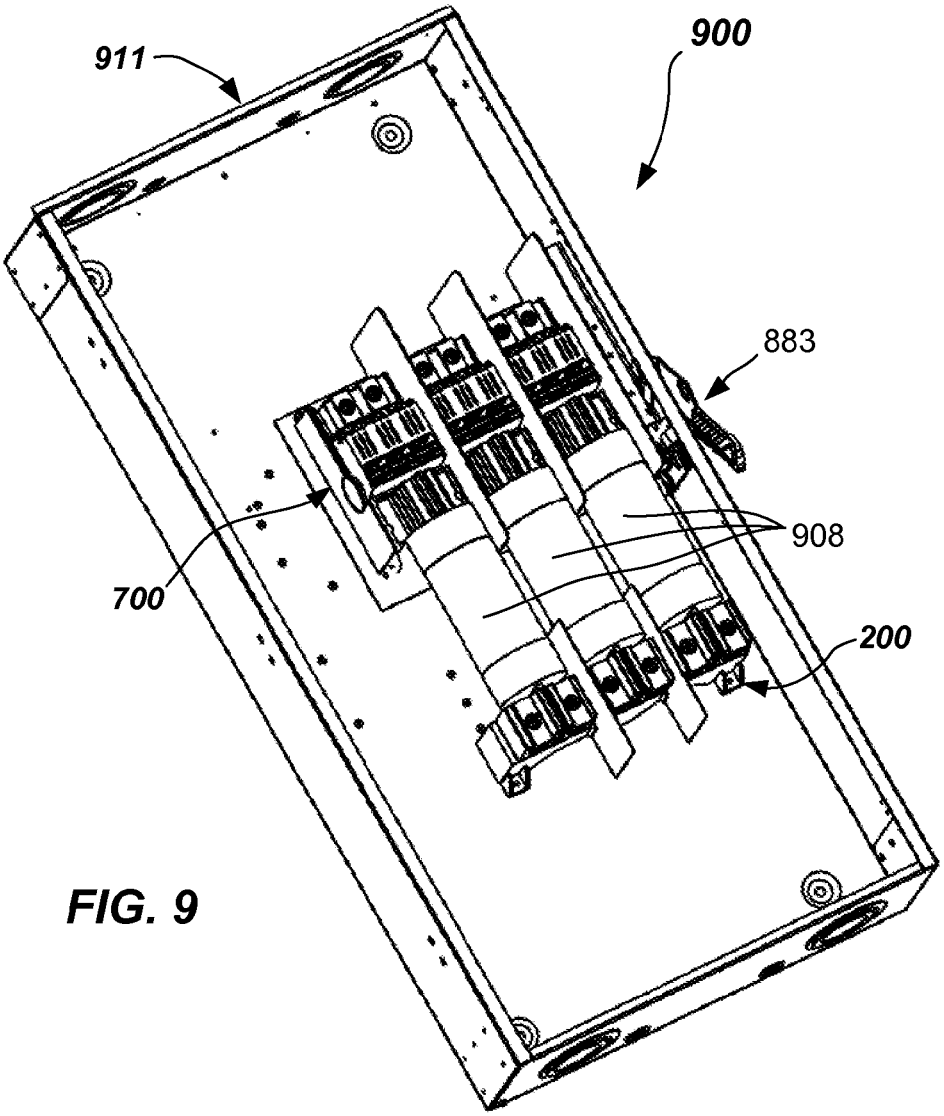
FIG. 9 illustrates a perspective view of a fusible switch assembly installed within an enclosure according to embodiments.

FIG. 2 illustrates a partially exploded view of a load base assembly 200 in accordance with one or more embodiments of the invention. Load base assembly 200 may be included in a fusible switch assembly 900 (see FIG. 9) and is useful to connect electrical power from a line base switch assembly 700 through one or more fuses 908 to one or more electrical loads in accordance with one or more embodiments of the invention. Load base assembly 200 may include a load base 202 configured to couple to a portion (e.g., a back wall portion) of an enclosure 911 (e.g., a switch or fuse box as shown in FIG. 9). A suitable NEMA enclosure may be used, such as a NEMA 1 or NEMA 12 enclosure for Indoor use, or NEMA 3R or NEMA 4X enclosure for outdoor use, for example.

Coupling attachment to the enclosure 911 may be made by connection features 202C of the load base 202, such as two or more tabs shown that receive fasteners (not shown). Other numbers of tabs or types of connection features 202C may be used. Load base 202 may be made of any suitable insulating material, for example a polymer insulating material such as a thermoset plastic (e.g., polyester material). The thermoset plastic may be mineral filled, glass-reinforced, or both. Load base assembly 200 may also include one or more fuse clip and lug assemblies 205A-205C that may be attached to the load base 202, such as by fasteners 207 (e.g., screws, bolts, or the like). Fuse clip and lug assemblies 205A-205C may be identical to each other in their construction, as will be described with reference to FIGS. 3A and 3B herein. In the case of a 3-pole version shown, three positions for attachment of fuse clip and lug assemblies' 205A-205C are provided. Two fuse clip and lug assemblies 205A, 205C may be provided in a 2-pole version, such as at the outer two locations, leaving the center location vacant.

Load base 202 may include one or more barriers 210 that separate the poles from one another. Barriers 210 may be received and secured in slots 204S formed in the sides and/or top of the body of the load base 202. In the depicted embodiment, the barriers 210 may be included in a barrier assembly 212 including the barriers 210 and an interconnecting bridge 212B. Interconnecting bridge 212B may include one or more base registration features 212F (e.g., one or more holes) that may register on one or more bosses 202B formed on the upper surface of the body of the load base 202. Other suitable registration features may be used.

Fuse Clip and Lug Assembly

Now referring to FIGS. 3A-3D, a fuse clip and lug assembly 205B, that may be used in the load base assembly 200, and components thereof are shown as representative examples. Fuse clip and lug assembly 205B may include a lug body 314, which may comprise a single-piece extruded construction. Lug body 314 may be made of a 6061 aluminum alloy material, for example. Other suitably conductive metals may be used. Lug body 314 may be extruded to form the various length-wise extending features and then cut to length along the extrusion direction 314E as indicated by arrow.

Fuse clip and lug assembly 205B includes a first lug 316 formed in the lug body 314 that is configured to receive a first load-side electrical wire (not shown). A second lug 318 may also be formed in the lug body 314 and may be configured to receive a second load-side electrical wire (not shown). First lug 316 and second lug 318 may each be sized and configured to receive a conductor wire having a size between about 1/0 AWG and about 600 kcmil that may be suitable for a 400 A-600 A fusible switch assembly, such as fusible switch assembly 900 (FIG. 9). First and second lugs 316, 318 may include a semi-circular portion that is of a semi-circular shape in cross-section and adapted to receive the first and second electrical wires.

First and second slide features 320, 322, which may comprise opposing grooves formed in and extending from front to back into the lug body 314, may be provided above semi-circular portions of each of the first lug 316 and the second lug 318. Grooves may be about 0.13 inch deep (about 3.3 mm deep) and about 0.31 inch high (about 7.9 mm high) and extend from front to back. Other sized grooves may be used. Any suitably shaped groove may be used. First and second sliding nuts 324, 326 are configured to be slidably received in each of the first and second slide features 320, 322, respectively. First and second sliding nuts 324, 326 may include edges that are configured to slide in the first and second slide features 320, 322.

One end of the first and second sliding nuts 324, 326 may include one or more stops 320S, 322S that interface with and abut the lug body 314 and function to limit an amount of insertion of the first and second sliding nuts 324, 326 into the first and second slide features 320, 322. First and second sliding nuts 324, 326 may include a threaded bore that receives first and second wire fastener 328, 330, such as a hex head set screw shown. Other suitable wire fasteners may be used.

Figure 3A:
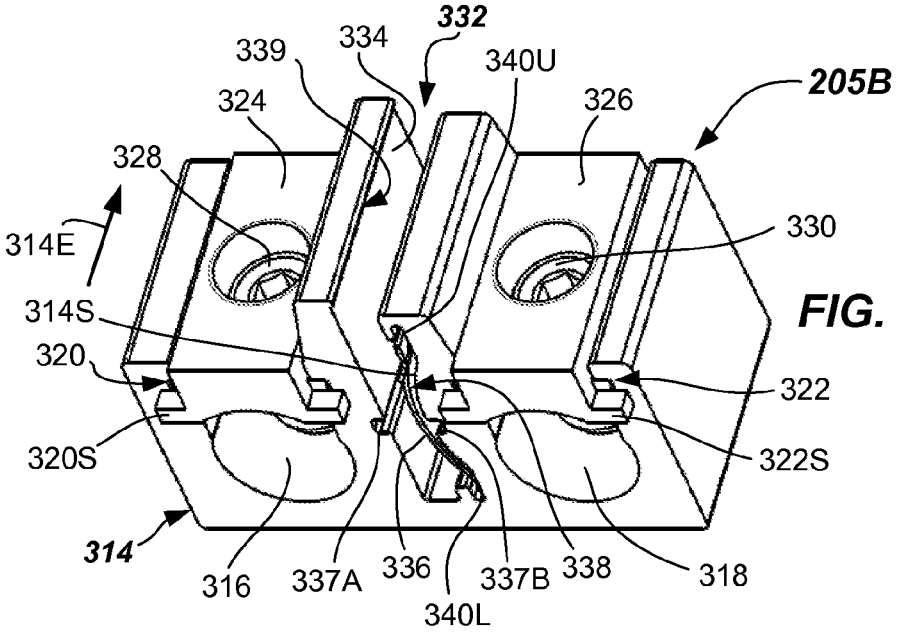
FIGS. 3A and 3B illustrate top and bottom perspective views of a fuse clip and lug assembly according to embodiments.
Figure 3B:
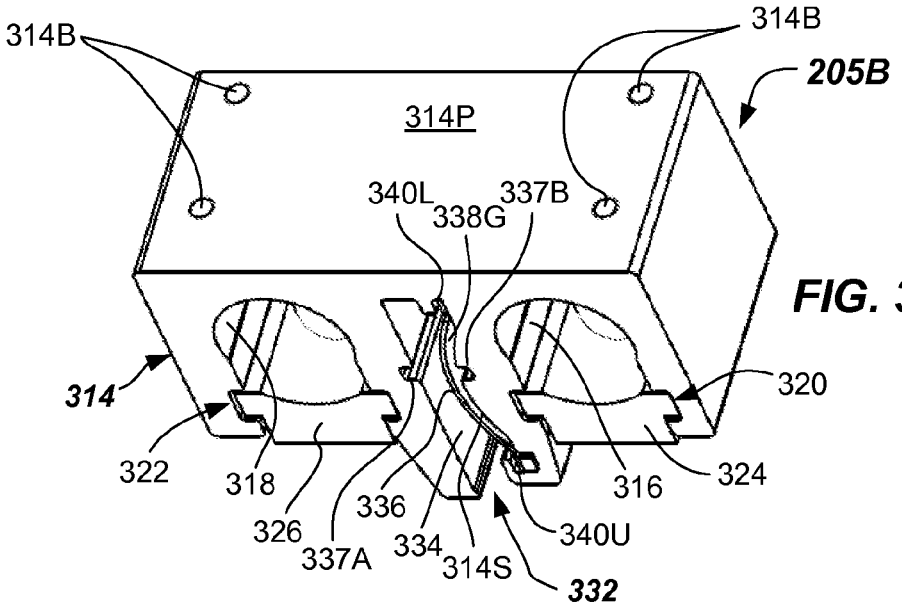
Figure 3C:
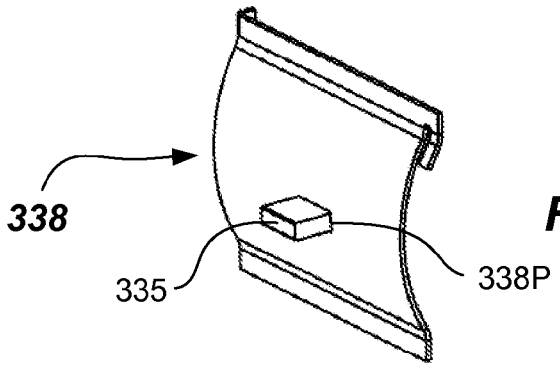
FIG. 3C illustrates a perspective view of leaf spring including a crossbar registered therein according to embodiments.
Figure 3D:
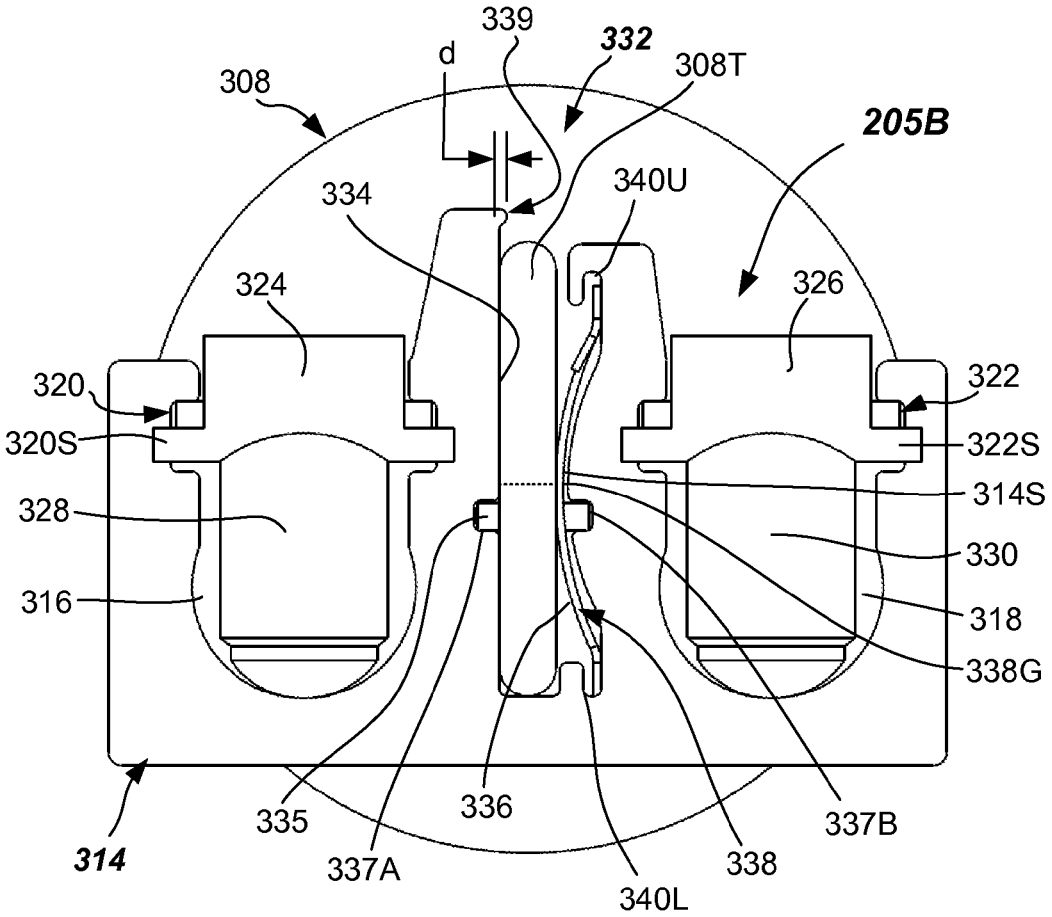
FIG. 3D illustrates a front plan view of fuse clip and lug assembly including an anti-walkout feature according to embodiments.

Fuse clip and lug assembly 205B also includes a fuse clip 332 at least partially formed by the lug body 314 and that may be centrally located between the first lug 316 and the second lug 318. Fuse clip 332 is configured and adapted to receive a fuse 308 including a fuse tang 308T as shown in FIG. 3D. In particular, fuse clip 332 may include a first clip side 334 located proximate to the first lug 316, that may include a substantially planar side surface (e.g. surface perpendicular to a surface of the underside) formed of the lug body 314. Fuse clip 332 may include a second clip side 336 located proximate to the second lug 318, which may include a moveable surface. The moveable surface of the second clip side 336 may be provided by a spring member 338 to provide spring force against the tang 308T of the fuse 308. Spring member 338 may be a leaf spring that may be received and secured in upper and lower retention features 340U, 340L formed into the lug body 314. The first clip side 334 and second clip side 336 may cooperate to secure the fuse 308 to the load base assembly 200. The construction of the first clip side 334 and second clip side 336 may be reversed in some embodiments.

In one or more embodiments, the fuse clip 332 may optionally include an anti-walkout feature 339. Anti-walkout feature 339 may include a lip formed on a portion of the lug body 314, such as on an upper end of the first clip side 334, and may be configured to prevent the tang 308T of the fuse 308 that is receivable in the fuse clip 332 from unwanted exiting (e.g., walking out of the fuse clip 332) due to vibration caused by system operation or other forces. The lip may extend beyond a surface of the first clip side 334 by a lip distance "d" which may be between about 0.02 (about 0.5 mm) and about 0.04 inch (about 1 mm), for example. The lip may include a radius, and may extend from front to back, as shown. The anti-walkout feature 339 will only allow the tang 308T to move out of the fuse clip 332 a defined distance before the tang 308T and anti-walkout feature 339 make contact with one another, further limiting the movement of the tang 308T. Enough side-to-side clearance is allotted in the fuse clip 332 to allow a user to insert or remove the fuse 308 by slightly rotating the fuse 308 in the fuse clip 332 to move around the tang 308T around the anti-walkout feature 339.

In one or more embodiments, the fuse clip 332 may include a fuse rejection feature. Fuse rejection feature may be included to reject certain types of fuses (e.g., all but class R fuses). Fuse rejection feature in some embodiments may be as shown in FIGS. 3C and 3D, and may include a crossbar 335. Crossbar 335 may be a rectangular-shaped bar that may be received within a fuse slot of the fuse clip 332. One end of the crossbar 335 may be received within, and register in, a first slot 337A formed in the lug body 314. Crossbar 335 may also be received in a second slot 337B formed in a support surface 314S located behind, and spaced from, the spring member 338 by a gap 338G. Spring member 338 (e.g., leaf spring) may include a pocket 338P that may be configured to slidably receive and restrain the crossbar 335 from back-and-forth movement within the first and second slots 337A, 337B.

The support surface 314S may include a domed portion (e.g., a truncated cylindrical dome), which may have a dome radius of about 1.25 inch (about 32 mm) and may be spaced from a back surface of the spring member 338 (e.g., leaf spring) by a gap 338G of between about 0.06 inch (about 1.5 mm) and about 0.12 inch (about 3 mm). This gap 338G and support surface 314S may be used to prevent plastic deformation (yielding) of the spring member 338, and may allow only elastic deformation thereof.

As shown, the underside of the lug body 314 may include a planar surface 314P including threaded bores 314B configured to receive fasteners 207 (FIG. 2). Each of the features, such as the first and second lugs 316, 318, first and second slide features 320, 322, first clip side 334, support surface 314S, as well as the overall outside contours and shape may be formed by extrusion.

Line Base Assembly

Figure 4:
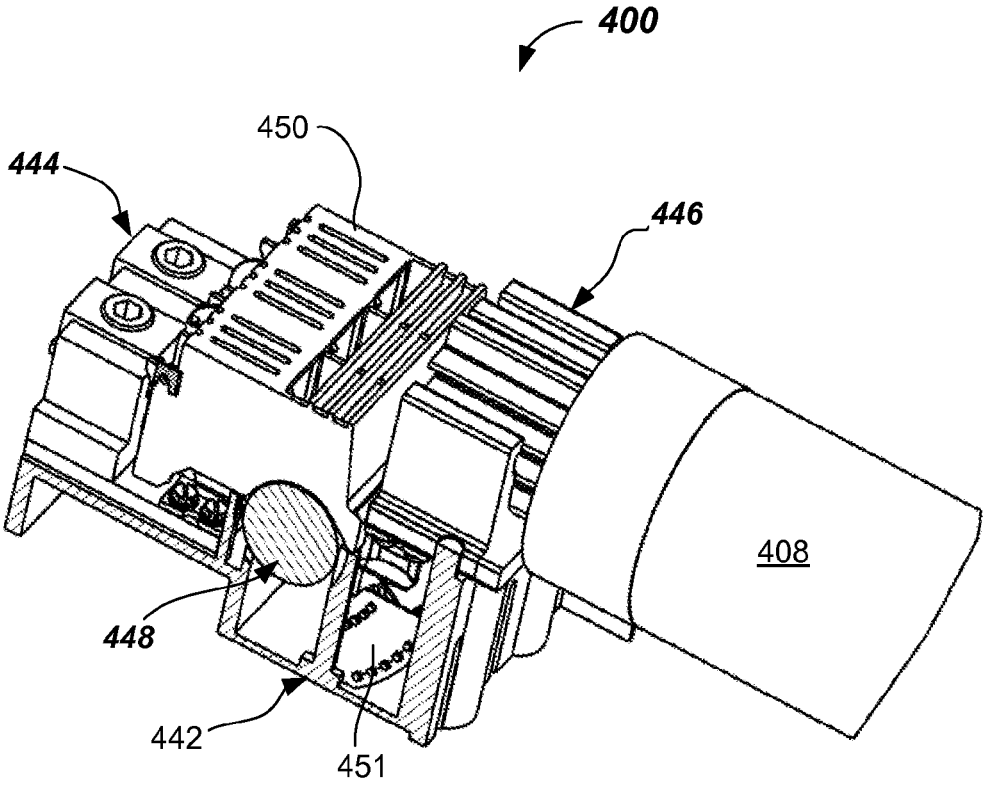
FIG. 4 illustrates a perspective view of a line base assembly according to embodiments.

FIG. 4 illustrates a line base assembly 400 in accordance with one or more embodiments of the invention. Line base assembly 400 may be used on a line side of the fusible switch assembly 900 (FIG. 9). Line base assembly 400 includes a line base 442, and a line bus connector assembly 444 and fuse clip assembly 446 coupled to the line base 442 (only a portion shown). Line base 442 may also include a rotor assembly 448 (to be described later with reference to FIG. 8) mounted for rotation relative to the line base 442 and also for rotation relative to the line bus connector assembly 444 and the fuse clip assembly 446. Other components such as arc shields 450 and arc grids 451 may be included.

Line base assembly 400 is operational to receive and secure line wire conductors (not shown) at the line bus connector assembly 444 and pass current to the fuse 408, and also allow electrical disconnection/connection via rotation of the rotor assembly 448 as will be apparent from the following. Two or three of the line base assemblies 400 shown in FIG. 4 may be included in a line base switch assembly 700 (See FIGS. 7A-7B), depending upon the amperage rating of the line base switch assembly 700 and the number of poles included therein.

For example, a 400 Amp, 3-pole line base switch assembly 700 may include 3 poles and a line base assembly 400 per pole. One of the stationary contacts per pole may be inactive (or even not included). A 400 Amp, 2-pole line base switch assembly may include 2 poles and a line base assembly 400 per pole, with one of the stationary contacts being inactive. In this version, a line base 742 may be used, but the center pole region would be unused. A 600 Amp, 3-pole line base switch assembly (e.g., line base switch assembly 700 as shown) may include 3 poles and a line base assembly 400 per pole. A 600 Amp, 2-pole line base switch assembly may include 2 poles and a line base assembly 400 per pole. In this version, a common line base 742 may be used, but the center pole region would be unused.

Line Bus Connector Assembly

Figure 5A:
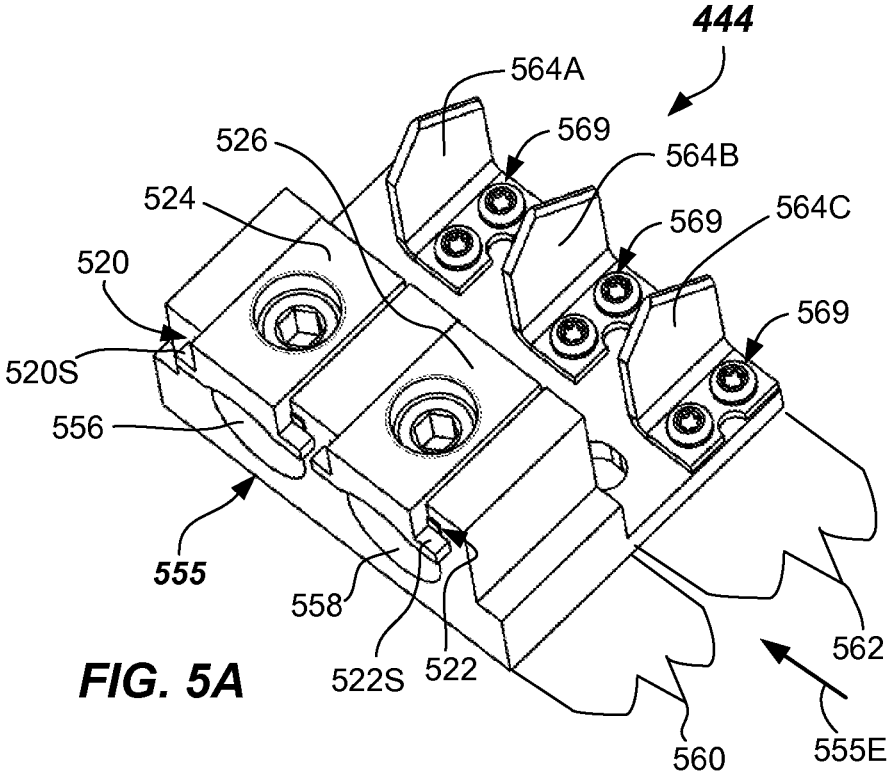
FIGS. 5A and 5B illustrate top and bottom perspective views of a line bus connector assembly according to embodiments.
Figure 5B:
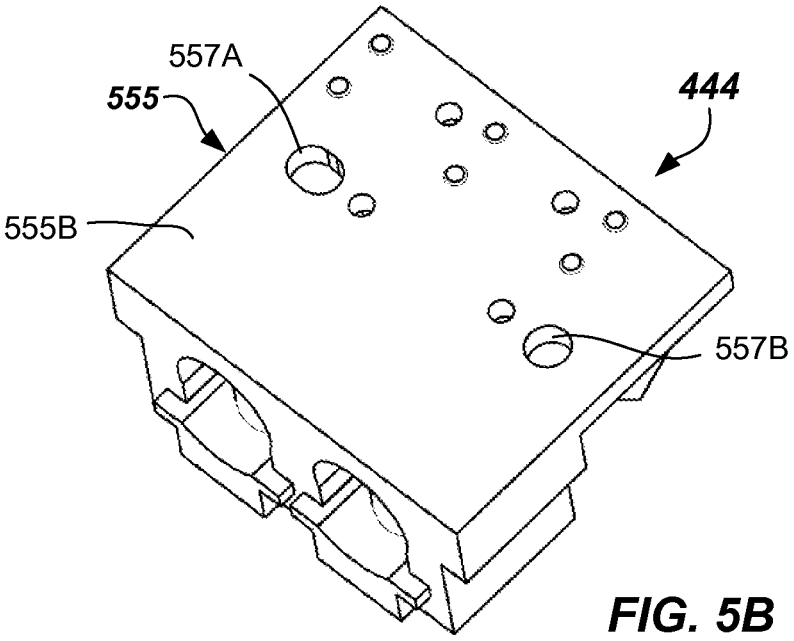

In more detail, and referring to FIGS. 5A-5B, an embodiment of the line bus connector assembly 444 that may be used in the line base assembly 400 is shown. Line bus connector assembly 444 includes a single-piece connector body 555, which may include extruded 6061 aluminum alloy construction. Single-piece connector body 555 may include a bottom 555B that may be substantially planar and configured to attach to the line base 442 of the line base assembly 400 (FIG. 4). Bosses formed on and extending from a surface of the line base 442 may serve to register and locate the line bus connector assembly 444 on the line base 442 by registering in first and second holes 557A, 557B, one of which may be elongated as shown. First line lug 556 and second line lug 558 may be formed in the single-piece connector body 555, and first and second sliding nuts 524, 526 may be slidably received in first and second slide features 520, 522 (e.g., grooves) provided in the single-piece connector body 555 above the first and second line lugs 556, 558, as previously described. First and second line lugs 556, 558 may be sized to accept 1/0 AWG to 600 kcmil line wire conductors. Like the fuse clip and lug assembly 205B previously described, stops 520S, 522S may be provided on the first and second sliding nuts 524, 526 to limit an extent of travel into the first and second slide features 520, 522.

The single-piece connector body 555 includes a first body portion 560 and a second body portion 562 extending from the first body portion 560 on a side opposite a line wire conductor entry side. A height of the second body portion 562 is thinner than a height of the first body portion 560. Second body portion 562 may include a same thickness throughout, and include a planar upper surface. Line bus connector assembly 444 includes stationary contacts 564A-564C (otherwise referred to herein as "line-side stationary contacts") attached to the second body portion 562, such as by fasteners 569 (e.g., bolts or screws or the like). Other fastening methods may be used. Stationary contacts 564A-564C may be made of a copper material, may be bent in an L-shape, and may include pointed tips thereon, as shown.

In some embodiments, an outer contour configuration of the first body portion 560 and the second body portion 562 of the line bus connector assembly 444 may be extruded. Thus, an extruded component including the structure and contours of the first and second body portions 560, 562 may be formed in the extrusion direction 555E. The extrusion may be cut to the overall length of the line bus connector assembly 444, and then machined to form the final features of the first and second body portions 560, 562, including forming of the first and second line lugs 556, 558, slide features for the sliding nuts 524, 526, the first hole 557A and second hole 557B and threaded bores that receive the fasteners 569. This manufacturing process may result in substantially reduced material and manufacturing cost.

Fuse Clip Assembly

Figure 6A:
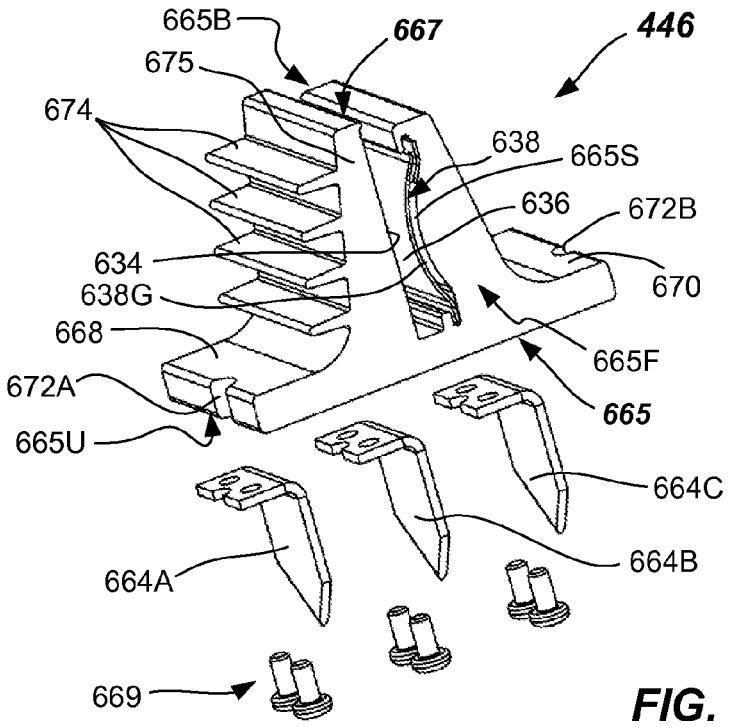
FIGS. 6A and 6B illustrate a partially-exploded top and bottom perspective views of a line bus connector assembly according to embodiments.
Figure 6B:
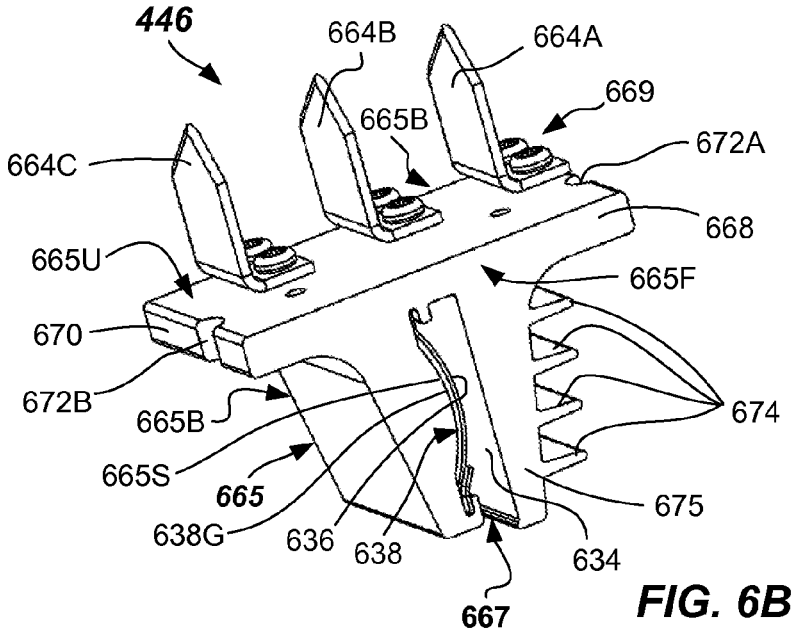

Referring now to FIGS. 6A-6B, an embodiment of the fuse clip assembly 446 that may be used in the line base assembly 400 of FIG. 4 is shown and described. Fuse clip assembly 446 includes a clip body 665 that is a single piece, which may include extruded 6061 aluminum alloy construction. Clip body 665 includes a front side 665F and a back side 665B opposite the front side 665F, and an underside 665U. Clip body 665 includes a fuse clip 667 formed therein. Fuse clip 667 includes a first clip side 634 and a moveable clip side 636, as previously described. A spring member may be provided by a leaf spring 638, which may form the moveable clip side 636. Leaf spring 638 may be manufactured from a bent piece of spring-type steel the same as is shown in FIG. 3C.

The clip body 665 may include a first flange 668 and a second flange 670 extending in opposite lateral directions. Registration features 672A, 672B may be provided on the first flange 668 and the second flange 670, such as on the terminal ends thereof, and may register with another feature formed on the line base 442 (FIG. 4). Registration features 672A, 672B may be detents as shown. Other suitable registration features may be used to locate and align the fuse clip assembly 446 with the line base 442. Stationary contacts 664A-664C (otherwise referred to herein as "load-side stationary contacts") may be attached to the underside 665U of the clip body 665 by fasteners 669 (e.g., bolts or screws or the like). Other fastening methods may be used. Stationary contacts 664A-664C may be made of a copper material, may be bent in an L-shape, and may include pointed tips thereon, as shown.

The stationary contacts 664A-664C may be attached and positioned in line with the fuse clip 667 formed in the clip body 665 as shown, i.e., connected directly under a projected footprint of the clip body 665 projecting from the underside 665U, wherein the footprint is outlined by the terminal ends of the flanges 668, 670 and the front and back sides 665F, 665B of the clip body 665. Thus, the stationary contacts 664A-664C are all substantially aligned underneath the fuse clip 667 when viewed from the side (in a direction from first flange 668 to second flange 670). Thus, the fuse clip assembly 446 exhibits a shorter front-to-back profile than prior art fuse clip assemblies, thus shortening the overall length of the line base switch assembly 700 (FIG. 7). In the depicted embodiment, the clip body 665 may include fins 674 (a few labeled).

Fins 674 may extend laterally from a side of the upright 675 including the first clip side 634 and help cool the upright 675 and fuse clip 667. Fins 674 may number four as shown or other suitable numbers of fins. As described for the fuse clip and lug assembly 205B discussed above, the fuse clip 667 may include a support surface 665S that may be a truncated cylindrical dome. A gap 638G may be provided between the leaf spring 638 and the support surface 665S such that deflection due to installation of the fuse 408 may be limited to elastic deformation only.

Line Base Switch Assembly

Figure 7A:
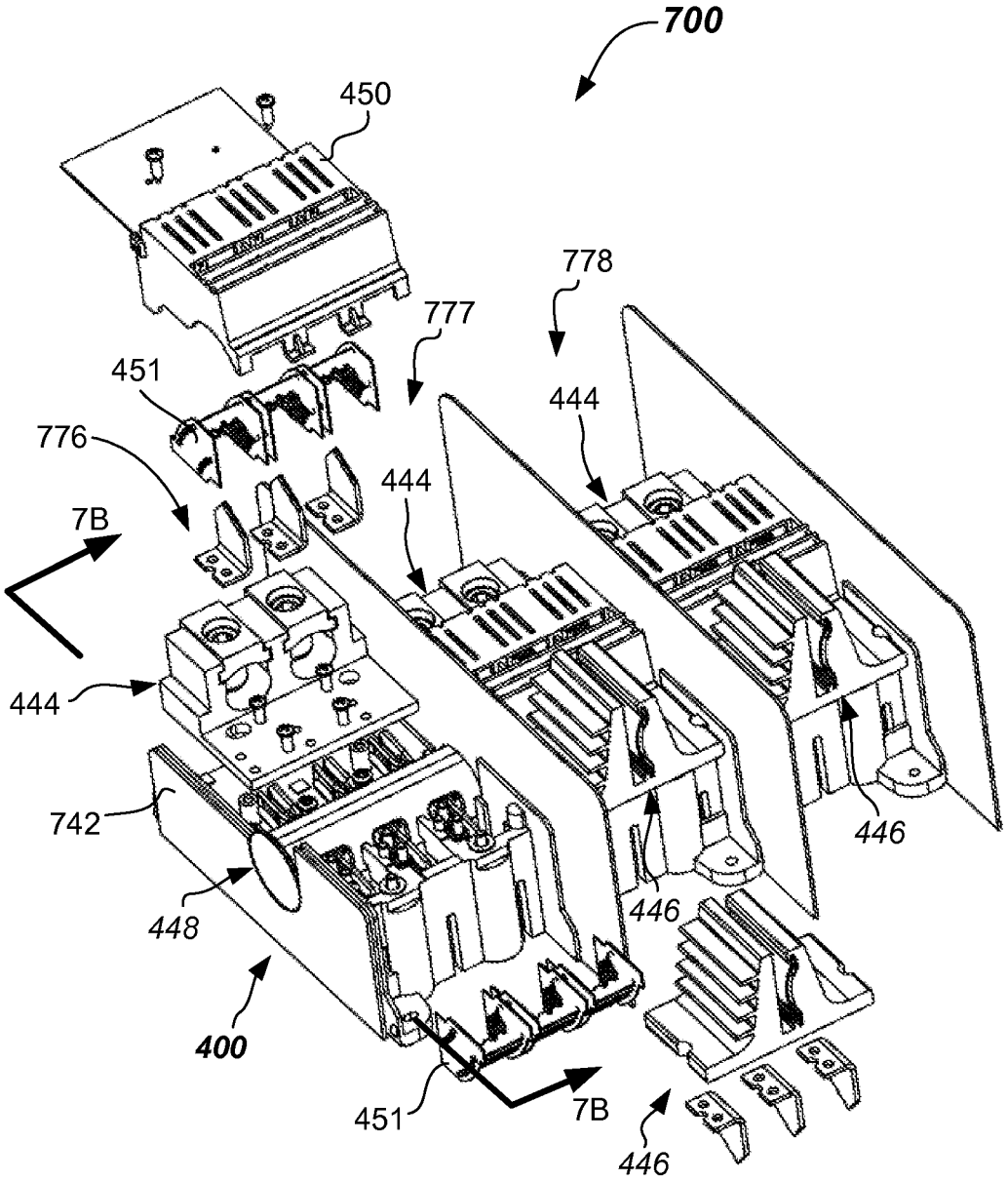
FIG. 7A illustrates a partially-exploded perspective view of a line base assembly according to embodiments.
Figure 7B:
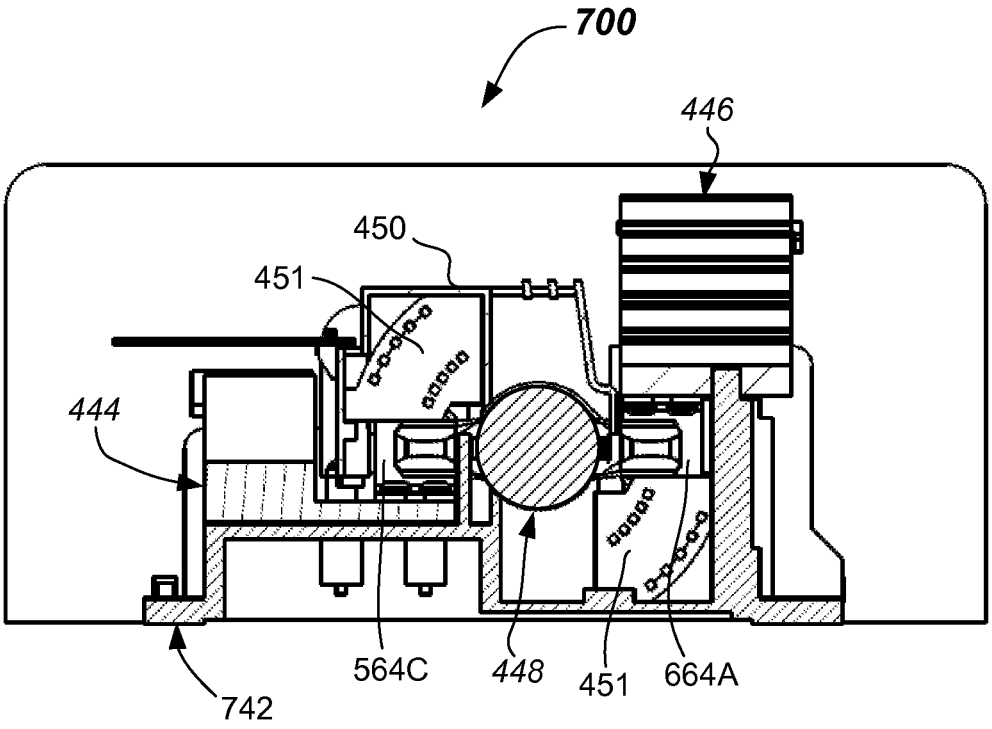
FIG. 7B illustrates a cross-sectioned view of a line base assembly according to embodiments.

FIGS. 7A and 7B illustrate various views of a line base switch assembly 700 provided in accordance with one or more embodiments. Line base switch assembly 700 includes a line base assembly 400. Line base assembly 400 includes the line base 742, a line bus connector assembly 444 (as previously described) coupled to the line base 742, and the fuse clip assembly 446 (as previously described) coupled to the line base 742. Line base switch assembly 700 may also include a rotor assembly 448 that is mounted for rotation relative to the line base 742.

A line base switch assembly 700 including 3 poles, namely first pole 776, second pole 777, and third pole 778 are shown in FIG. 7A. Each of these first, second, and third poles 776, 777, 778 may include the line bus connector assembly 444 and the fuse clip assembly 446 as previously described herein. However, not all poles may be used. For example, a 2-pole version may not use the second pole 777, and only include a line bus connector assembly 444 and fuse clip assembly 446 at the first pole 776 and the third pole 778. Furthermore, less than three stationary contacts may be included in each line bus connector assembly 444 and fuse clip assembly 446, such as in a 2-pole, 400 Amp version of a line base switch assembly.

As is shown in FIG. 7B, blades (e.g., first and second blades 881, 882 of FIG. 8) of the rotor assembly 448 may be rotated to couple and electrically connect to the stationary contacts (e.g. 564A-564C) of the line bus connector assembly 444 and to the stationary contacts (e.g. 664A-664C) of the fuse clip assembly 446. Arc grids 451 may be provided proximate to each stationary contact 564A-564C, 664A-664C and function to minimize arcing.

Figure 8:
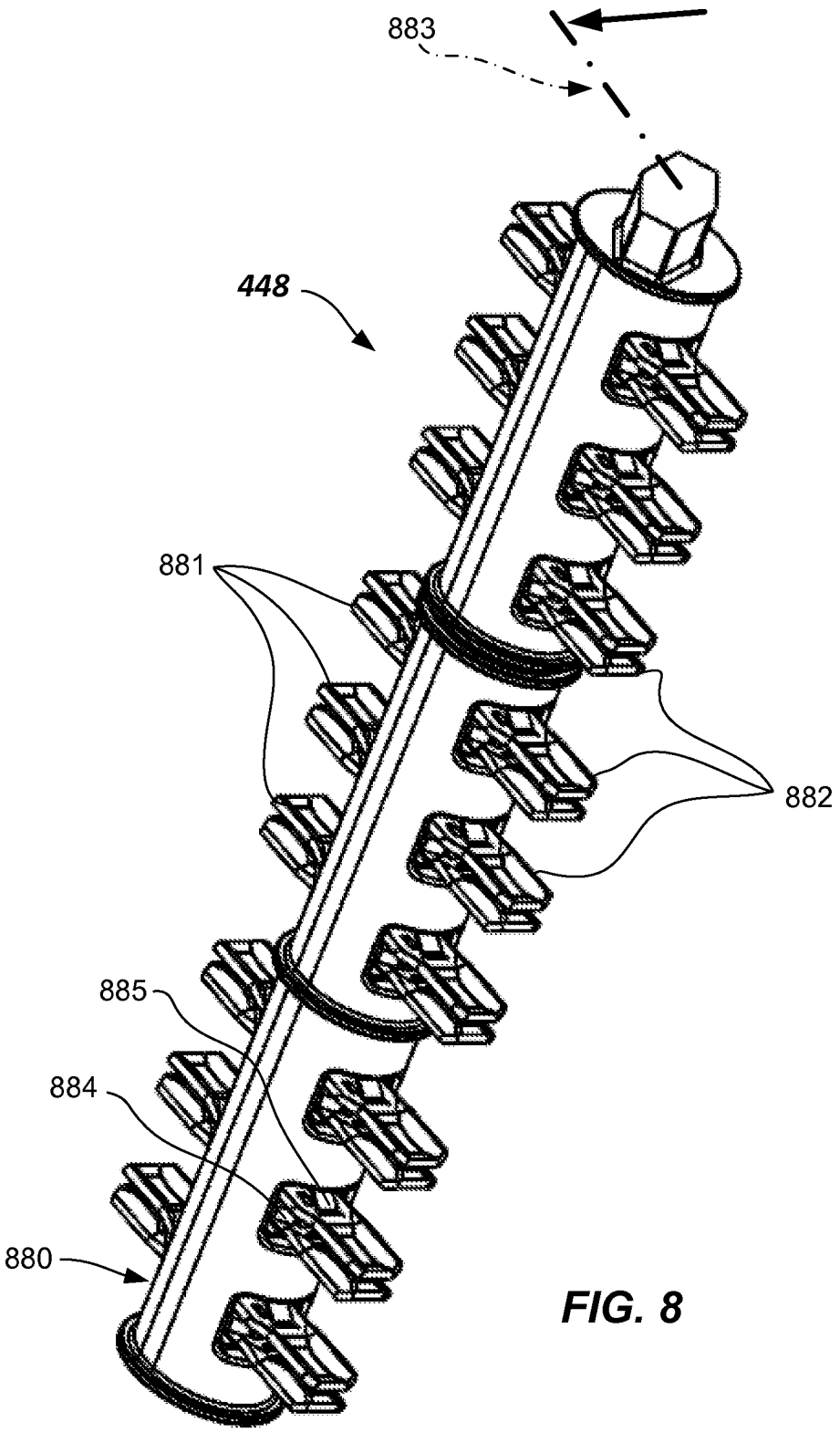
FIG. 8 illustrates a perspective view of a rotor assembly according to embodiments.

FIG. 8 illustrates a perspective view of an example of a rotor assembly 448 that may be used in the line base switch assembly 700 (FIG. 7A-7B) and the line base assembly 400 (FIG. 4). Rotor assembly 448 includes a rotor body 880 and coupled first blades 881 and second blades 882, which may be generally opposed from one another, as shown. First blades 881 are configured to electrically connect to the stationary contacts 564A-564C (FIG. 5A) of the line bus connector assembly 444. Second blades 882 are configured to electrically connect to the stationary contacts 664A-664C (FIG. 6A-6B) of the fuse clip assembly 446. Rotor assembly 448 is mounted for rotation relative to the line base 742 and the rotor assembly 448 and first and second blades 881, 882 may be rotated by a suitable rotation mechanism (rotation mechanism 883 designated by line shown) such as a lever and cable mechanism coupled to the rotor assembly 448. Rotation mechanism 883 may be mounted to an enclosure (e.g., enclosure 911 of FIG. 9) including the line base switch assembly 700. Rotation mechanism 883 may be used to open and close the line base switch assembly 700.

Each of the blades 881, 882 of the rotor assembly 448 may include blade spacers 884 located in between the individual blades to keep them spaced apart, as desired. Blade spacers 884 may be annular rings. Blade springs 885 may be added to apply a force to ensure proper electrical contact when the rotor assembly 448 is rotated to make contact with and receive the stationary contacts 564A-564C of the line bus connector assembly 444 between the first blades 881, and the stationary contacts 664A-664C of the fuse clip assembly 446 between the second blades 882. Other suitable constructions of the rotor assembly 448 may be used. Some or the blades 881, 882 may be omitted in 400 A versions, as well as in 2-pole versions of the line base switch assembly.

FIG. 9 illustrates a fusible switch assembly 900 that includes a line base switch assembly 700 as described above, a load base assembly 200 as described above and interconnected fuses 908. The line base switch assembly may be operated via a rotation mechanism 883, as is conventional. Fusible switch assembly 900 may be included in a suitable enclosure 911. Line conductor wires (not shown) may enter through knockouts in the top, and load wire conductors (not shown) may exit through knockouts in the bottom, for example. Other components may be provided in the enclosure 911 and additional barriers may be added in this case.

Figure 10:
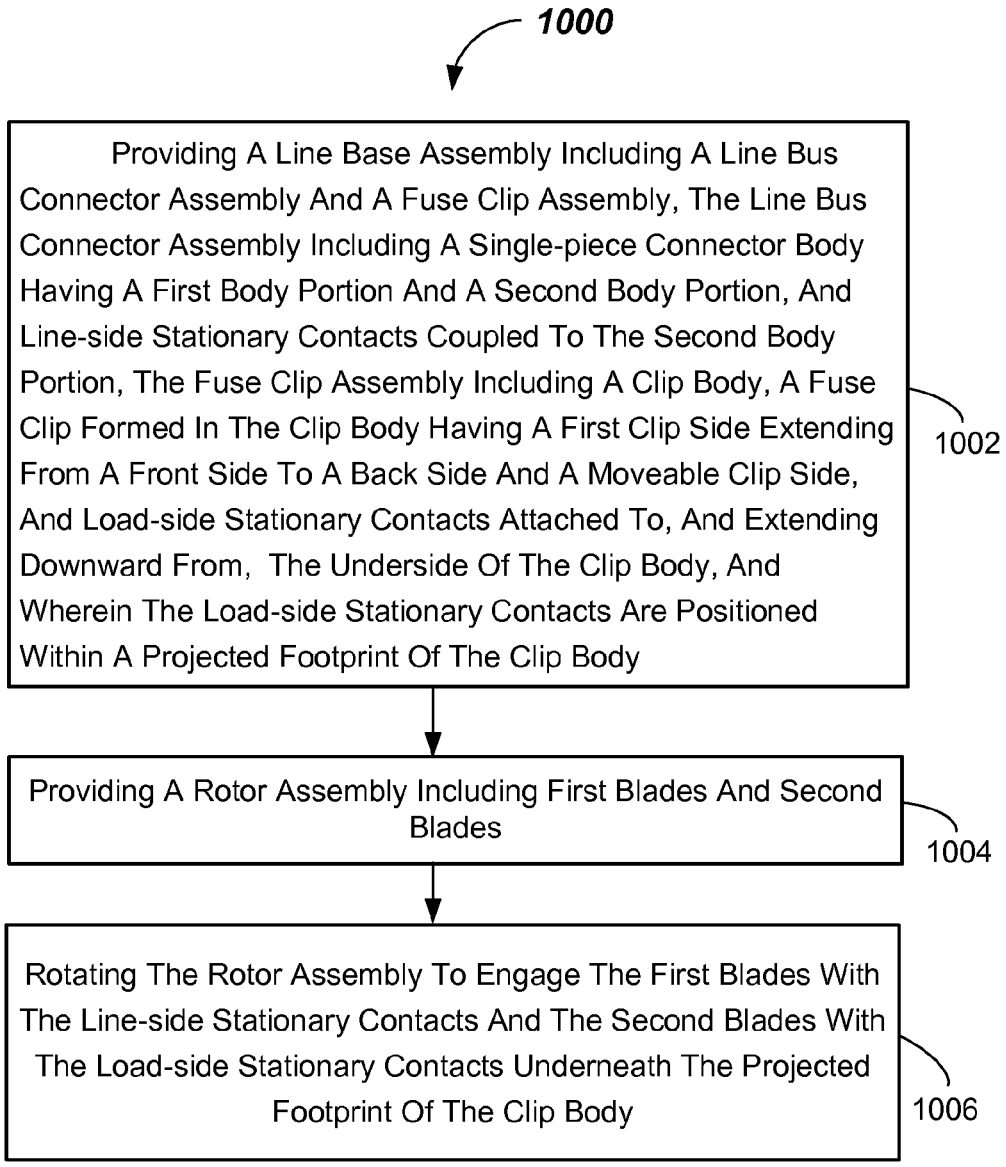
FIG. 10 illustrates a flowchart of a method of operating a line base assembly according to embodiments.

FIG. 10 illustrates a method operating a line base assembly (e.g., line base assembly 400), in accordance with some embodiments of the invention. Line base assembly 400 may be included in a line base switch assembly 700. Method 1000 includes, at 1002, providing a line base assembly (e.g., line base assembly 400) including a line bus connector assembly (e.g., line bus connector assembly 444) and a fuse clip assembly (e.g., fuse clip assembly 446), the line bus connector assembly including a single-piece connector body (e.g., single-piece connector body 555) having a first body portion (e.g., first body portion 560) and a second body portion (e.g., second body portion 562), and line-side stationary contacts (e.g., stationary contacts 564A-564C) coupled to the second body portion, the fuse clip assembly including a clip body (e.g., clip body 665), a fuse clip (e.g., fuse clip 667) formed in the clip body having a first clip side (e.g., first clip side 634) extending from a front side to a back side and a moveable clip side (e.g., moveable clip side 636), and load-side stationary contacts (e.g., stationary contacts 664A-664C) attached to, and extending downward from, an underside (e.g., underside 665U) of the clip body, and wherein the load-side stationary contacts are positioned within a projected footprint of the clip body. Projected footprint is the circumscribed area of the underside 665U as projected away from the underside.

The method 1000 includes, in 1004, providing a rotor assembly (e.g., rotor assembly 448) including first blades (e.g. blades 881) and second blades (e.g., second blades 882), and, in 1006, rotating the rotor assembly to engage the first blades with the line-side stationary contacts and the second blades with the load-side stationary contacts underneath the projected footprint of the clip body.

It should be readily appreciated by those persons skilled in the art that the invention is susceptible of broad utility and application. Many embodiments and adaptations of the invention other than those described herein, as well as many variations, modifications, and equivalent arrangements, will be apparent from, or reasonably suggested by, the invention and the foregoing description thereof, without departing from the substance or scope of the present invention. Accordingly, while the invention has been described herein in detail in relation to specific embodiments, it is to be understood that this disclosure is only illustrative and presents examples of the invention and is made merely for purposes of providing a full and enabling disclosure of the invention. This disclosure is not intended to limit the invention to the particular devices, systems or methods disclosed, but, to the contrary, the intention is to cover all modifications, equivalents, and alternatives falling within the scope of the invention.

What is claimed is:

1. A load base assembly, comprising:

a load base; and one or more fuse clip and lug assembly coupled to the load base, the fuse clip and lug assembly including:

a lug body including a first lug configured to receive a first electrical wire, and a second lug configured to receive a second electrical wire, first and second slide features formed in the lug body, first and second sliding nuts configured to be received in the slide first and second slide features, and a fuse clip at least partially formed by the lug body between the first lug and the second lug, wherein the fuse clip includes a domed support surface to prevent plastic deformation of a spring member and allow elastic deformation of the spring member, and wherein one end of the first and second sliding nuts include one or more stops that interface with and abut the lug body and function to limit an amount of insertion of the first and second sliding nuts into the first and second slide features.

2. The load base assembly of claim 1, comprising three of the fuse clip and lug assembly, one attached at each of three spaced locations on the load base.

3. The load base assembly of claim 1, wherein the fuse clip comprises a fuse rejection element having a crossbar that registers in a first slot formed in the lug body.

4. The load base assembly of claim 1, wherein the fuse clip includes a moveable portion comprising a leaf spring, and a fuse rejection element including a crossbar received in a pocket of the leaf spring.

5. The load base assembly of claim 1, wherein the fuse clip includes a leaf spring as the spring member and the domed support surface spaced from the leaf spring by a gap sufficient to prevent plastic deformation of the leaf spring.

6. The load base assembly of claim 1, wherein the fuse clip comprises an anti-walkout feature comprising a lip formed on a portion of the lug body configured to prevent a tang of a fuse adapted to be receivable in the fuse clip from walking out of the fuse clip.

7. The load base assembly of claim 1, comprising a barrier assembly including barriers and an interconnecting bridge, the interconnecting bridge including one or more base registration features that register on one or more bosses formed on an upper surface of the load base.

8. A line base assembly, comprising:

a line base;

a line bus connector assembly coupled to the line base, the line bus connector assembly including:

a single-piece connector body including a first body portion and a second body portion extending from the first body portion and being thinner than first body portion, first and second line lugs formed in the first body portion, and first and second slide features formed in the single-piece connector body, first and second sliding nuts configured to be received in the first and second slide features, and stationary contacts coupled to the second body portion; and a fuse clip assembly configured to receive a fuse, the fuse clip assembly including:

a clip body including a front side, a back side, and an underside, wherein the clip body is a single piece, a fuse clip formed in the clip body having a first clip side extending from the front side to the back side and a moveable clip side, and stationary contacts attached to, and extending downward from, the underside of the clip body, and wherein the stationary contacts are positioned within a projected footprint of the clip body, wherein the fuse clip includes a domed support surface to prevent plastic deformation of a spring member and allow elastic deformation of the spring member, and wherein one end of the first and second sliding nuts include one or more stops that interface with and abut the lug body and function to limit an amount of insertion of the first and second sliding nuts into the first and second slide features.

9. A line base switch assembly including the line base assembly of claim 8 and a rotor assembly mounted for rotation relative to the line base.

10. A line bus connector assembly, comprising:

a single-piece connector body including a first body portion and a second body portion extending from the first body portion and being thinner than first body portion, first and second line lugs formed in the first portion, and first and second slide features formed in the single-piece connector body;

first and second sliding nuts configured to be received in the first and second slide features; and stationary contacts coupled to the second body portion, wherein a fuse clip includes a domed support surface to prevent plastic deformation of a spring member and allow elastic deformation of the spring member, and wherein one end of the first and second sliding nuts include one or more stops that interface with and abut a lug body and function to limit an amount of insertion of the first and second sliding nuts into the first and second slide features.

11. The line bus connector assembly of claim 10, wherein an outside thickness and configuration of the first body portion and the second body portion is extruded.

12. A fuse clip assembly, comprising:

a clip body including a front side, a back side, and an underside, wherein the clip body is a single piece;

a fuse clip formed in the clip body having a first clip side extending from the front side to the back side and a moveable clip side; and stationary contacts attached to, and extending downward from, the underside of the clip body, and wherein the stationary contacts are positioned within a projected footprint of the clip body, wherein the fuse clip includes a domed support surface to prevent plastic deformation of a spring member and allow elastic deformation of the spring member, and wherein first and second sliding nuts configured to be received in first and second slide features respectively and one end of the first and second sliding nuts include one or more stops that interface with and abut a lug body and function to limit an amount of insertion of the first and second sliding nuts into the first and second slide features.

13. The fuse clip assembly of claim 12, wherein the clip body includes a first flange and a second flange extending in opposite directions.

14. The fuse clip assembly of claim 13, comprising registration features provided on the flanges that are configured to register with a feature on a line base.

15. The fuse clip assembly of claim 12, wherein the clip body includes fins extending from a side of an upright including the first clip side.

16. A fusible switch assembly, comprising:
a load base assembly including:
a load base; and
one or more fuse clip and lug assembly coupled to the load base, the fuse clip and lug assembly including:
a lug body including a first lug configured to receive a first electrical wire, and a second lug configured to receive a second electrical wire,
first and second load slide features formed in the lug body,
first and second load sliding nuts configured to be received in each of the first and second load slide features, and
a fuse clip at least partially formed by the lug body between the first lug and the second lug; and
a line base assembly including:
a line base;
a line bus connector assembly coupled to the line base, the line bus connector assembly including:
a single-piece connector body including a first body portion and a second body portion extending from the first body portion and being thinner than first body portion, first and second line lugs formed in the first portion, and first and second line slide features formed in the single-piece connector body,
first and second line sliding nuts configured to be received in the first and second line slide features, and
line-side stationary contacts coupled to the second body portion; and
a fuse clip assembly configured to receive a fuse, the fuse clip assembly including:
a clip body including a front side, a back side, and an underside, wherein the clip body is a single piece,
a fuse clip formed in the clip body having a first clip side extending from the front side to the back side and a moveable clip side, and
load-side stationary contacts attached to, and extending downward from, the underside of the clip body, and wherein the stationary contacts are positioned within a projected footprint of the clip body,
wherein the fuse clip includes a domed support surface to prevent plastic deformation of a spring member and allow elastic deformation of the spring member, and
wherein one end of the first and second sliding nuts configured to be received in each of the first and second load slide features formed in the lug body include one or more stops that interface with and abut the lug body and function to limit an amount of insertion of the first and second sliding nuts into the first and second slide features.

17. A fuse clip and lug assembly, comprising:
a lug body including a first lug configured to receive a first electrical wire, and a second lug configured to receive a second electrical wire;
first and second slide features formed in the lug body;
first and second sliding nuts configured to be received in the slide first and second slide features; and
a fuse clip at least partially formed by the lug body between the first lug and the second lug,
wherein the fuse clip includes a domed support surface to prevent plastic deformation of a spring member and allow elastic deformation of the spring member, and
wherein one end of the first and second sliding nuts include one or more stops that interface with and abut the lug body and function to limit an amount of insertion of the first and second sliding nuts into the first and second slide features.

18. The fuse clip and lug assembly of claim 17, wherein the fuse clip comprises a fuse rejection element having a crossbar that registers in a first slot formed in the lug body.

19. The fuse clip and lug assembly of claim 17, wherein the fuse clip includes a leaf spring as the spring member, and the domed support surface spaced from the leaf spring by a gap sufficient to prevent plastic deformation of the leaf spring.

20. The fuse clip and lug assembly of claim 17, wherein the fuse clip comprises an anti-walkout feature comprising a lip formed on a portion of the lug body configured to prevent a tang of a fuse adapted to be receivable in the fuse clip from walking out of the fuse clip.

21. A fuse clip assembly, comprising:
a body;
a fuse clip at least partially formed by the body, the fuse clip including a first clip side and a moveable clip side and at least one slot formed therein, the moveable clip side including a spring member; and
a fuse rejection element including a crossbar that registers in the slot formed in the fuse clip,
wherein the fuse clip includes a domed support surface to prevent plastic deformation of a spring member and allow elastic deformation of the spring member, and
wherein first and second sliding nuts configured to be received in first and second slide features respectively and one end of the first and second sliding nuts include one or more stops that interface with and abut a lug body and function to limit an amount of insertion of the first and second sliding nuts into the first and second slide features.

22. The fuse clip assembly of claim 21, wherein the spring member includes a leaf spring as the spring member and the domed support surface is spaced from the leaf spring by a gap sufficient to prevent plastic deformation of the leaf spring.

23. The fuse clip assembly of claim 21, wherein the fuse clip comprises an anti-walkout feature comprising a lip formed on a portion of the body configured to prevent a tang of a fuse adapted to be receivable in the fuse clip from walking out of the fuse clip.

24. A method of operating a line base assembly, comprising:
providing a line base assembly including a line bus connector assembly and a fuse clip assembly, the line bus connector assembly including a single-piece connector body having a first body portion and a second body portion, and line-side stationary contacts coupled to the second body portion, the fuse clip assembly including a clip body, a fuse clip formed in the clip body having a first clip side extending from a front side to a back side and a moveable clip side, and load-side stationary contacts attached to, and extending downward from, an underside of the clip body, and wherein the load-side stationary contacts are positioned within a projected footprint of the clip body;
providing a rotor assembly including first blades and second blades; and
rotating the rotor assembly to engage the first blades with the line-side stationary contacts and the second blades with the load-side stationary contacts underneath the projected footprint of the clip body,
wherein the fuse clip includes a domed support surface to prevent plastic deformation of a spring member and allow elastic deformation of the spring member, and wherein first and second sliding nuts configured to be received in first and second slide features respectively and one end of the first and second sliding nuts include one or more stops that interface with and abut a lug body and function to limit an amount of insertion of the first and second sliding nuts into the first and second slide features.

* * * * *